United States Patent [19]

Heffner et al.

[11] Patent Number: 4,964,567

[45] Date of Patent: Oct. 23, 1990

[54] EXPANSION AND CHECK VALVE COMBINATION

[75] Inventors: Joseph H. Heffner, Chesterfield; G. Thomas Seener; Dennis L. Hoehne, both of St. Louis, all of Mo.

[73] Assignee: Sporlan Valve Company, St. Louis, Mo.

[21] Appl. No.: 309,695

[22] Filed: Feb. 10, 1989

[51] Int. Cl.[5] ..... G05D 27/00; F25B 13/00

[52] U.S. Cl. ..... 236/92 B; 62/324.6; 137/512.1; 137/599

[58] Field of Search ..... 236/92 B; 62/527, 528, 62/160, 324.6; 137/599, 512.1, 533.17, 543.21

[56] References Cited

U.S. PATENT DOCUMENTS

| | | | |
|---|---|---|---|
| 2,323,480 | 7/1943 | MacDougall | 137/559 X |
| 3,461,681 | 8/1969 | Smith et al. | 62/160 X |
| 4,214,698 | 7/1980 | Josefsson | 137/599 |
| 4,852,364 | 8/1989 | Seener et al. | 62/225 |

*Primary Examiner*—William E. Wayner

*Attorney, Agent, or Firm*—Cohn, Powell & Hind

[57] ABSTRACT

This combination expansion valve and check valve (18) includes a valve body (22) having an inlet (24) and a outlet (26). A control valve (28) is disposed between the inlet and the outlet which controls flow through the valve when refrigerant flow is normal and pressure is higher at the inlet than the outlet. A by-pass conduit (60) is connected between the inlet and the outlet and includes an external conduit (62) and a passage (70) within the valve communicating with the outlet. A check valve (58) is disposed within the passage which selectively blocks flow through the conduit. The check valve includes a floating disc (66) moving between spaced check valve ports (61, 63) to block flow through the conduit when the expansion valve is operating and to permit flow through the conduit when flow is reversed. Two identical valves (18*a*) and (18*b*) are reversely connected to tandem to operate alternatively as expansion valves in a heat pump system (10).

9 Claims, 2 Drawing Sheets

FIG. 7.
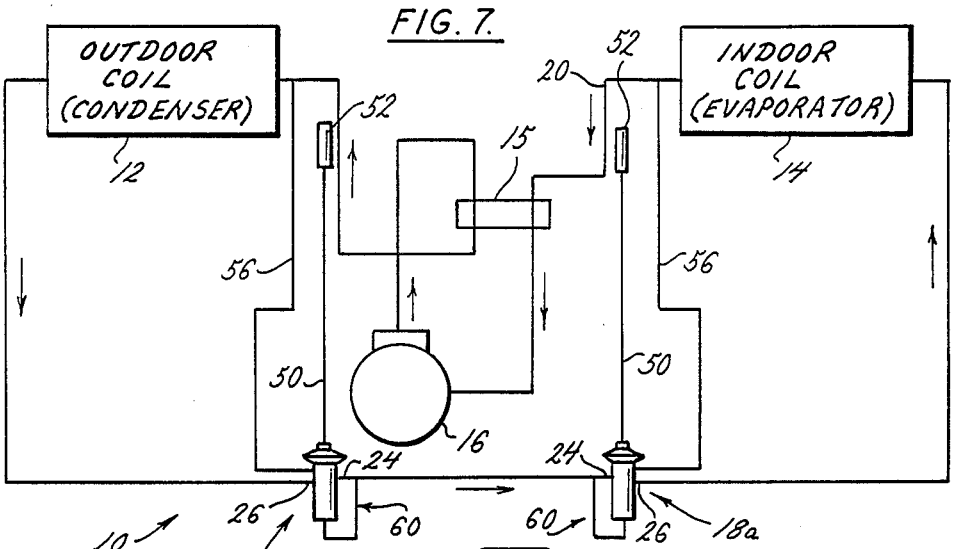
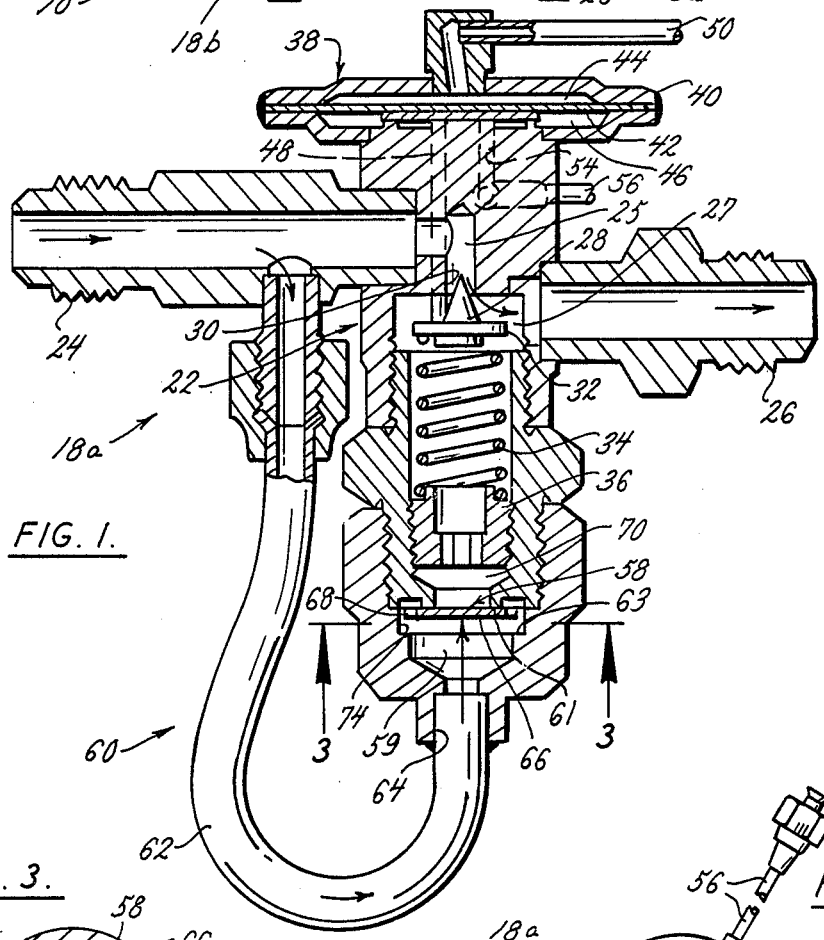
FIG. 1.
FIG. 3.
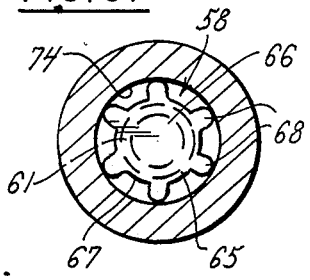
FIG. 2.
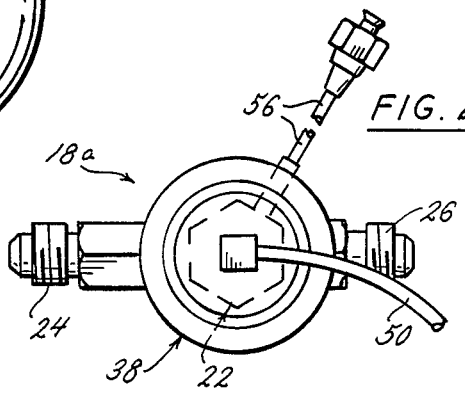

FIG. 8.
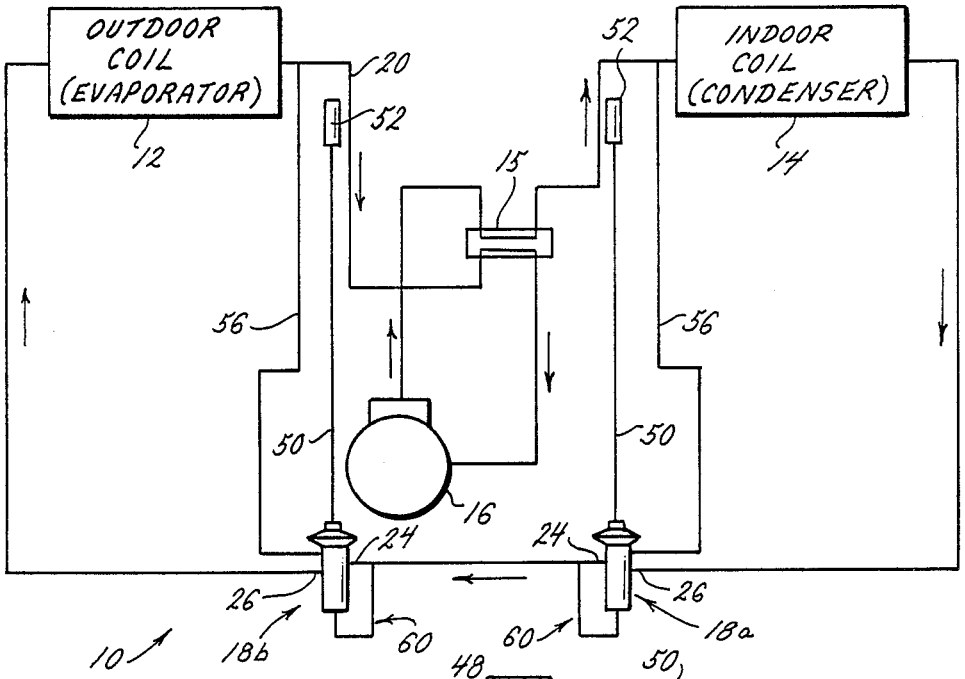
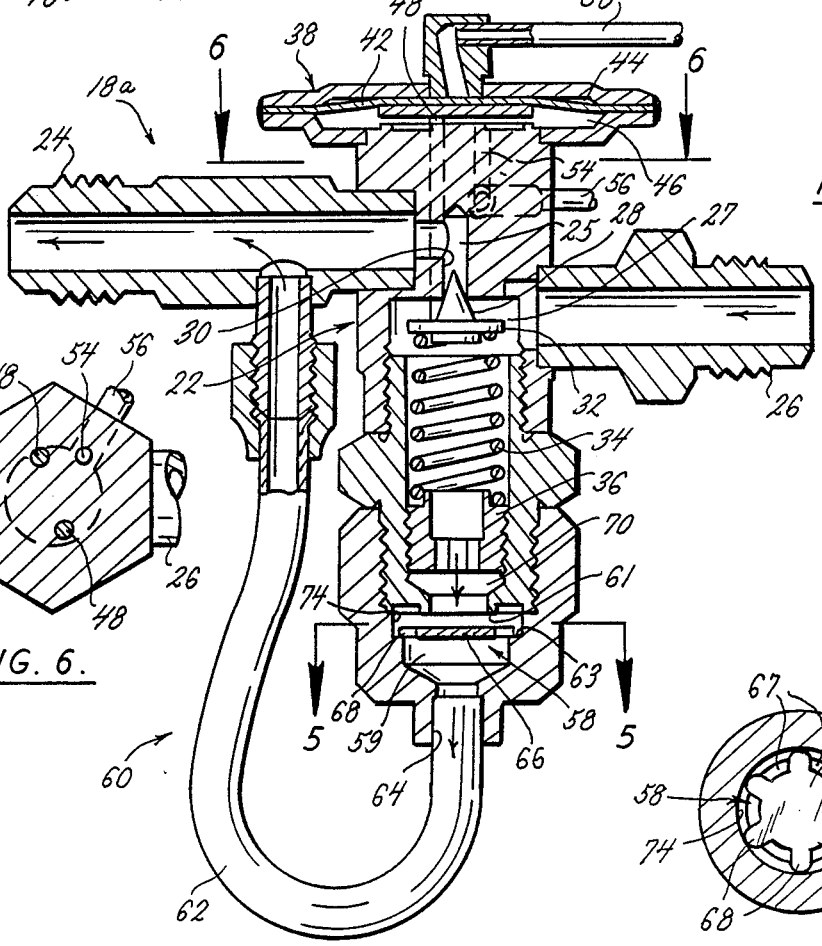
FIG. 4.
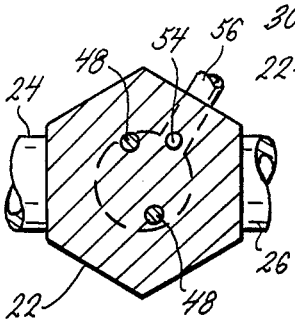
FIG. 6.
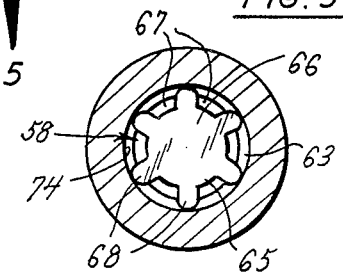
FIG. 5.

EXPANSION AND CHECK VALVE COMBINATION

BACKGROUND OF THE INVENTION:

This invention relates generally to expansion valves in refrigeration and air conditioning systems and in particular to an improved expansion valve which incorporates a reverse flow check valve.

Expansion valves are used in refrigerator and air conditioning systems and heating systems as flow control devices which restrict the flow of liquid refrigerant as it passes from the condensor to the evaporator. Essentially, expansion devices control the flow of liquid refrigerants so that it arrives at the evaporator at a uniform rate consistent with the heat transfer capability of the evaporator coil.

Such expansion devices fall generally into two categories, namely fixed orifice devices and variable orifice valves. In addition, variable orifice valves themselves may be separated into two general classes namely automatic valves and thermostatic valves.

Thermostatic expansion valves are disclosed in U.S. Pat. No. 2,786,336 (H. T. Lange), U.S. Pat. No. 3,742,722 (Leimbach) and U.S. Pat. No. 3,738,573 (Eschbaugh). The first two of these three patents are commonly owned by the owner of the present invention. U.S. Pat. No. 2,786,336 is directed to providing an expansion valve which compensates for any increased pressure differential across the valve port, for any increased pressure unbalance of the valve port and for any increase of suction temperature caused by the valve throttles, upon an increase of valve inlet or head pressure. U.S. Pat. No. 3,742,722 is directed toward providing an expansion valve in which the valve member is pressure balanced by way of an orifice therethrough which communicates the inlet port with a chamber defined by the valve housing and valve member, the inlet pressure thus acting on equal areas of opposite sides of the valve member. Finally, U.S. Pat. No. 3,738,573 is directed to the provision of an expansion valve of pressure balance construction for controlling flow in both large and small units. Later improvements are disclosed in U.S. Pat. No. 4,852,364, also commonly owned, and provide a means of combining an expansion and check valve as one discrete valve.

In some refrigeration and air conditioning systems, and heat pumps represent a prime example, it is necessary to provide for reverse refrigerant flow in the system. If any of the known expansion valves, such as those disclosed in the three patents discussed above are used in the system, it is necessary to provide parallel piping for an independent check valve in addition to the expansion valve. In the normal flow direction, the check valve closes and the refrigerant flow is directed to the expansion valve. In the reverse flow direction, the check valve opens to allow refrigerant to bypass the expansion valve. Systems of this type are not only cumbersome but tend to be expensive. With respect to the improvement disclosed in U.S. Pat. No. 4,852,364, of which the present invention represents a further improvement, the combination expansion and check valve solves this problem to a large extent by providing a check valve element which is disposed in the direct flow line between the inlet and outlet. However, this combination valve does not always solve the problem and tends not to be cost effective in some situations.

The present invention solves these problems in a manner not disclosed in the known prior art.

SUMMARY OF THE INVENTION

This invention provides an expansion valve capable of controlling flow between a condensor an evaporator and when flow is normal and incorporates a built-in check valve for permitting reverse flow through the expansion valve when the expansion feature is not required, without requiring a separate expansion valve by-pass system.

The invention provides a combination valve comprising a valve body including an inlet and an outlet, said outlet receiving refrigerant at a lower pressure than the refrigerant pressure in said inlet when refrigerant flow is in a normal direction from said inlet to said outlet; a control valve means disposed between said inlet and said outlet including a control valve port, a control valve element movable into and out of engagement with said control valve port to regulate flow between said inlet and outlet when refrigerant flow is normal, and said control valve element being urged into engagement with said control valve port when refrigerant flow is reversed; by-pass conduit means operatively connecting said inlet and outlet including passage means disposed within the body and check valve means disposed within said passage means, said check valve means including check valve port means, a check valve element selectively movable into and out of engagement with said port means, said check valve element preventing flow between said inlet and outlet chambers, when refrigerant flow is normal, and said check valve element permitting relatively free flow between said outlet and inlet chambers when refrigerant flow is reversed; and means for controlling movement of the control valve element when the refrigerant flow is normal.

It is an aspect of this invention to provide a valve controlling means which includes a pressure responsive motor means in the form of a diaphragm assembly and means subjecting the diaphragm to a control pressure.

It is another aspect of this invention to provide connecting means between the diaphragm and the control valve element in the form of at least one elongate stem connected to the diaphragm at one end and to the control valve element at the other end.

It is a further aspect of the invention to provide that the by-pass conduit means includes an external conduit extending between the inlet and the passage means disposed within the body.

Yet another aspect of the invention is to provide that the check valve means includes a chamber having spaced seats defining said port means, and the check valve element includes a disc movable in said chamber between said spaced seats.

An important aspect of this invention is to provide an expansion valve which can be used in tandem in a reversible refrigeration system, such as a heat pump, with a minimum of additional piping and valving and with a significant simplification and cost saving.

BRIEF DESCRIPTION OF THE DRAWINGS

FIG. 1 is a longitudinal cross section through the combination valve showing use in a refrigeration mode;

FIG. 2 is a plan view of said valve;

FIG. 3 is a cross sectional view taken on line 3—3 of FIG. 1;

FIG. 4 is a similar view to FIG. 1 showing use in a reverse flow mode;

FIG. 5 is a cross sectional view taken on line 5—5 of FIG. 4;

FIG. 6 is a cross sectional view taken on line 6—6 of FIG. 4;

FIG. 7 is a diagrammatic representation of a heat pump system utilizing two valves in a cooling cycle; and FIG. 8 is a representation of the same system in a heating cycle.

DESCRIPTION OF THE PREFERRED EMBODIMENT

Referring now by reference numerals to the drawings and first to FIGS. 7 and 8 it will be understood that a heat pump system is illustrated by numeral 10. The system includes essentially an outdoor coil 12, an indoor coil 14, a compressor 16, a four-way valve 15 and two combination expansion and check valves 18*a* and 18*b*. These valves are identical except that they are reversely placed in the system 10. The valves function as an expansion valve or provide free flow depending on their orientation in the system.

In the cooling cycle FIG. 7, refrigerant vapor at high pressure is passed from the compressor 16 by way of a four-way valve 15 to the outdoor coil 12, which acts as a condensor. Refrigerant liquid is passed through combination valve 18*b* in an open condition which allows unrestricted flow into combination valve 18*a* at high pressure and emerges as refrigerant at low pressure. The refrigerant then flows to the indoor coil 14 which acts as an evaporator. From the indoor coil 14, refrigerant vapor at low pressure is returned by way of the four-way valve 15 to the compressor 16 and the cooling cycle is completed.

In the heating cycle, FIG. 8, refrigerant vapor at high pressure is passed from the compressor 16 by way of the four-way valve 15 to the indoor coil 14, which acts as a condensor. Refrigerant liquid is then passed into combination valve 18*a* in an open condition to allow free flow of refrigerant to combination valve 18*b*. Refrigerant liquid at high pressure passes into combination valve 18*b* which acts as an expansion valve so that the refrigerant emerges at low pressure and passes into the outdoor coil 12 which is acting as an evaporator. From the outdoor coil 12 refrigerant vapor is returned by way of the four-way valve 15 to the compressor 16. This arrangement eliminates the need to provide a separate by-pass line between inlet and outlet, with a separate check valve for the expansion valves since the expansion valves incorporate a check valve.

The structural arrangement of parts of the combination valves 18*a*, 18*b* which permits reverse flow, will now be described in detail with reference to FIGS. 1–6.

Referring now to FIG. 1 the combination check and expansion valve 18*a* includes a body 22. Under normal refrigeration flow conditions shown, there is an inlet fitting 24, communicating with an upper chamber 25, to which liquid refrigerant is delivered at relatively high pressure and leaves said body 22 by way of an outlet fitting 26, communicating with a lower chamber 27, at relatively low pressure.

The expansion function of the combination valve 18*a* is actuated through a tapered control valve element 28 which is received in a valve aperture 30 formed in the upper portion of the body 22. The control valve element 28 includes a flanged spring retainer 32 which receives the upper end of a superheat spring 34, the lower end of said spring being received by a lower spring support 36.

A motor assembly 38 is connected to the upper end of the valve body 22. The motor assembly 38 includes a casing 40 providing a housing for a diaphragm 42, and said diaphragm 42 constitutes a motor element. The diaphragm 42 cooperates with the casing 40 to define an upper diaphragm compartment 44 and a lower diaphragm compartment 46. The diaphragm 42 is connected to two control rods 48 (see FIG. 6). These control rods 48 move with said diaphragm 42 and are disposed in bearing relation on the control valve spring retainer 32.

Referring to FIG. 7, the upper diaphragm compartment 44 communicates with a capillary tube 50 having a thermostatic bulb 52 at a remote end which is disposed in thermal responsive contact relation with the suction line 20 adjacent the indoor coil 14 (evaporator) outlet. A limited charge of refrigerant e.g. Freon, is introduced into the bulb 52. Below a predetermined temperature at the bulb the charge is partly in liquid phase and partly in vapor phase. Accordingly, the pressure in the upper diaphragm compartment 44 responds to changes in superheat in the suction line 20. The lower diaphragm compartment 46 communicates with an offset equalizer passage 54 formed in the upper portion of the valve body 22 which, by means of an external equalizer connection 56, communicates with the indoor coil 14 (evaporator) downstream of the inlet of said indoor coil 14 so that said lower compartment experiences substantially the same pressure as said indoor coil 14 at the location of the bulb 52.

Because of this structural arrangement of parts, movement of the diaphragm 42 and the dual control rods 48 in response to a change in pressure differential between the upper and lower diaphragm compartments 44 and 46, is transmitted to spring retainer 32 and hence to the control valve element 28, such movement being opposed by the superheat spring 34. The control rods 48 provide a connection means between the diaphragm 42 and the control valve element 28 and the control valve aperture 30 is therefore controlled by the superheat in the suction line 20, which affects pressure in the upper diaphragm compartment 44, and by the downstream pressure in the indoor coil which affects pressure in the lower diaphragm compartment 46. Accordingly, the bulb 52 and the equalizer connection 56 cooperate to provide a means of subjecting the diaphragm to a control pressure. In addition, the size of the annular opening between the control valve aperture 30 and the control valve element 28 is affected by the strength of the superheat spring 34 which is chosen to suit the particular system in which the expansion combination valve 18*a* is used. Thus, various factors contribute to controlling the control valve aperture opening and in effect, the control valve element 28 provides a control valve function when the refrigerant flow is normal.

The expansion and check valve has an alternative route for refrigerant which is blocked by a check valve 58 when refrigerant flow is normal (see FIG. 1). This alternative route between the inlet 24 and outlet 26 is defined by a by-pass conduit means 60 which includes an external line 62 and an internal valve passage 70. The external line 62 is connected at one end to the inlet fitting 24 before the fitting fully connects with the valve body 22. At the other end external line 62 is attached as by brazing to an aperture 64 communicating with the passage 70 in the valve body 22. The check valve 58 is disposed within the passage 70 which includes a valve chamber 59, defined in part by an upper annular seat 61 and a lower annular seat 63 constituting check valve port means (see FIGS. 1 and 4) When refrigerant flow is normal as in FIG. 1, the refrigerant going through the conduit means 60 is completely blocked by check valve 58. As shown in FIG. 3, this is accomplished by a floating disc element 66 which has a circular portion 65 and a plurality of radial tabs 68 around the circumference and provides a check valve element. When refrigerant flow is normal, refrigerant passing through the conduit means 60 and exerts pressure on the floating disc member 66 to urge it into engagement with the upper annular seat 61 which, because the diameter of the inner portion 65 is greater than the inner diameter of said seat, prevents refrigerant flowing through the disc member 66 and entering the portion of the internal conduit passage 70 communicating with outlet 26.

Combination valve 18*a* permits a relatively free flow of refrigerant when flow is reversed as shown in FIG. 4 and FIG. 8 during the heating cycle. During this cycle the refrigerant, after leaving the indoor coil 14 (acting now as a condensor) enters the reversed combination valve 18*a* through what was previously the outlet fitting 26 but is now an "inlet" fitting and into the main valve body. Because the indoor coil 14 is acting as a condensor, the pressure in the differential pressure between the lower diaphragm chamber 46 and the upper diaphragm chamber 44 coupled with reversal of flow results in the closure of the control valve aperture 30 by action of the superheat spring 34. Thus, refrigerant cannot flow from the "inlet" to the "outlet" and the refrigerant is routed through the valve body passageway 70. It then flows into the check valve 58 to urge the floating disc member 66 downward into engagement with annular seat 63. The tabs 68 of the floating disc member 66 are maintained in place laterally by the check valve walls 74. The configuration of the disc member 66 is such that, as shown in FIG. 5, the diameter of the inner portion 65 is less than the inner diameter of the lower annular seat 63 but the diameter across the tabs 68 is greater than the inner diameter of said seat which allow refrigerant to escape through the orifices 67 created between the floating disc member 66 and the seat 63 and into conduit external line 62. The refrigerant then flows into the inlet fitting 24 and leaves the combination valve 18*a* via the inlet fitting.

During the cooling cycle (FIG. 7) combination valve 18*a* acts as an expansion valve and valve 18*b* acts as an open valve. During the heating cycle (FIG. 8) combination valve 18*b* acts as an expansion valve and valve 18*a* acts as an open valve. Thus, by the use of two identical valves 18*a* and 18*b*, reversely placed in a system, one acts as an expansion valve and the other as an open valve depending on which cycle is in operation.

It is thought that the structural features of this expansion valve have become fully apparent from the foregoing description of parts, but for completeness of disclosure the operation of the valve will be briefly described.

During the cooling cycle in which the combination valve 18*a* acts as an expansion valve, the head pressure at the inlet fitting 24 is higher than the evaporator pressure at the outlet fitting 26. Liquid refrigerant enters the expansion valve 18*a* through the inlet fitting 24 and into a vertical chamber 25. The refrigerant is then controlled and metered through the control valve aperture 30 by movement of the tapered control valve element 28. The metered and expanded liquid refrigerant then flows out of the outlet fitting 26 en route to the indoor coil 14. This is the only passage for refrigerant traveling in the direction shown in FIG. 1. The refrigerant which enters the conduit 60 is blocked by the check valve 58 located at the bottom of the valve body 22 and the floating disc member 66 is urged against seat 61 and prevents refrigerant flow through the valve body passage 70.

However, during the heating cycle when the refrigerant pressure at the valve outlet fitting 26 of combination valve 18*a* becomes higher than that of the valve inlet fitting 24, the control valve element 28 is urged upward against the control valve aperture by the superheat spring 34. The refrigerant cannot now flow through the control valve aperture 30 and thus flows through the valve body and into the check valve 58. Accordingly, the floating disc member 66 is urged against lower seat 63 which allows refrigerant to flow through the spaces between the tabs 68. The refrigerant thereby has a relatively unobstructed flow into the conduit 60 which connects to the inlet fitting 24 directly and by-passes the control valve element 28.

Although the improved expansion valve has been described by making particularized reference to a preferred expansion valve mechanism, the details of description is not to be understood as restrictive, numerous variants being possible within the principles disclosed and within the fair scope of the claims hereunto appended.

I claim as my invention:

1. A combination expansion and check valve for controlling the flow of refrigerant in a refrigeration system comprising:

(a) a valve body including an inlet and an outlet, said outlet receiving refrigerant at a lower pressure than the refrigerant pressure in said inlet when refrigerant flow is in a normal direction from said inlet to said outlet, (b) a control valve means disposed between said inlet and said outlet including:

1. a control valve port,
2. a control valve element movable into and out of engagement with said control valve port to regulate substantially continuous flow between said inlet and outlet when refrigerant flow is normal, and
3. said control valve element being urged into engagement with said control valve port when refrigerant flow is reversed, (c) by-pass conduit means operatively connecting said inlet and outlet including passage means disposed within the body and an external conduit extending between the inlet and said passage means and check valve means disposed within said passage means, said check valve means including:

1. check valve port means,
2. a check valve element selectively movable into and out of engagement with said port means,
3. said check valve element preventing flow between said inlet and outlet chambers, when refrigerant flow is normal, and
4. said check valve element permitting substantially continuous relatively free flow between said outlet and inlet when refrigerant flow is reversed, and (d) means for controlling movement of the control valve element when the refrigerant flow is normal.

2. A combination valve as defined in claim 1, in which (e) the means controlling movement of the control valve includes a diaphragm housing attached to the body at one end and defining a diaphragm chamber having a diaphragm therewithin separating said chamber into a first compartment and a second compartment, means subjecting said diaphragm to a control pressure, and connecting means operatively connecting said diaphragm and said control valve element to control movement of said control valve element when the continuous refrigerant flow is normal.

3. A combination valve as defined in claim 2, in which:

(f) the means subjecting said diaphragm to a control pressure includes a means for subjecting said first diaphragm compartment to a vapor pressure responsive to temperature at the evaporator outlet.

4. A combination valve as defined in claim 2, in which:

(f) the means subjecting said diaphragm to a control pressure includes means for subjecting the second diaphragm compartment to evaporator pressure.

5. A combination valve as defined in claim 2, in which:

(f) the means subjecting said diaphragm to a control pressure includes a thermostatic bulb located at the evaporator outlet and having a fluid charge communicating with the first compartment and a passage in the valve body operatively communicating between the second diaphragm compartment and the evaporator.

6. A combination valve as defined in claim 2, in which:

(f) the valve body includes an elongate passage communicating between said diaphragm chamber and said outlet, and (g) the connecting means includes at least one stem received by said passage and having one end operatively connected to the diaphragm and the other end operatively connected to the control valve element to transmit movement of the diaphragm to the control valve element.

7. A combination valve as defined in claim 1, in which (f) the check valve means includes a chamber having spaced seats defining said port means, and (g) the check valve element includes a disc movable in said chamber between said spaced seats.

8. A combination expansion and check valve for controlling the flow of refrigerant in a refrigeration system comprising:

(a) a valve body including an inlet and an outlet, said outlet receiving refrigerant at a lower pressure than the refrigerant pressure in said inlet when refrigerant flow is in a normal direction from said inlet to said outlet, (b) a compound valve means disposed within the valve body between said inlet and said outlet including:

1. a control valve means for regulating a substantially continuous flow between said inlet and outlet when refrigerant flow is normal, and
2. check valve means opening to permit substantially continuous free flow through the valve body when refrigerant flow is reversed, (c) a by-pass conduit means operatively connecting said inlet and said outlet including passage means disposed within the body and an external conduit extending between the inlet and said passage means, the check valve being disposed within the passage means, and (d) means for controlling movement of the control valve when the refrigerant flow is normal.

9. A heat pump system comprising:

(a) a compressor, (b) an indoor coil, (c) an outdoor coil, (d) a four-way valve for directing refrigerant flow from the compressor selectively through the indoor coil and the outdoor coil, and (e) a pair of compound valves disposed in reverse tandem relation between the indoor coil and the outdoor coil, one of said valves acting as an expansion valve and the other valve being open when refrigerant flow is in one direction and the other of said valves acting as an expansion valve and said one valve being open when refrigerant flow is in the other direction each of said valves comprising:

1. a valve body including an inlet and an outlet, said outlet receiving refrigerant at a lower pressure than the refrigerant pressure in said inlet when refrigerant flow is in a normal direction from said inlet to said outlet,
2. a compound valve means disposed within the valve body between said inlet and said outlet including a control valve means for regulating substantially continuous flow between said inlet and outlet when refrigerant flow is normal, and check valve means opening to permit substantially continuous free flow through the valve body when refrigerant flow is reversed,
3. a by-pass conduit means operatively connecting said inlet and said outlet including passage means disposed within the body and an external conduit extending between the inlet and said passage means, the check valve being disposed within the passage means, and
4. means for controlling movement of the control valve when the refrigerant flow is normal.

* * * * *

UNITED STATES PATENT AND TRADEMARK OFFICE

CERTIFICATE OF CORRECTION

PATENT NO. : 4,964,567

DATED : October 23, 2990

INVENTOR(S) : Joseph H. Heffner, et al.

It is certified that error appears in the above-identified patent and that said Letters Patent is hereby corrected as shown below:

In the Abstract, line 17, delete "to" and add --in--. (1st occur.)

Column 2, line 7, delete "and".

Signed and Sealed this

Twenty-first Day of July, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,964,567

DATED : October 23, 1990

INVENTOR(S) : EXPANSION AND CHECK VALVE COMBINATION

It is certified that error appears in the above-identified patent and that said Letters Patent is hereby corrected as shown below:

On the title page: Item [56]

after "Filed: Feb. 10, 1989.", add
--Related U.S. Application Data
Continuation-in-part of Ser. No. 113,135, Oct. 23, 1987,
Pat. No. 4,852,364.--

Signed and Sealed this

Seventh Day of January, 1997

Bruce Lehman

*Attest:*

BRUCE LEHMAN

*Attesting Officer*

*Commissioner of Patents and Trademarks*

Disclaimer 4,964,567 — Joseph H. Heffner, Chesterfield; G. Thomas Seener; Dennis L. Hoehne, both of St. Louis, all of Mo. EXPANSION AND CHECK VALVE COMBINATION. Patent dated Oct. 23, 1990. Disclaimer filed Dec. 15, 1995, by the assignee, Sporian Valve Co..

The term of this patent shall not extend beyond the expiration date of Pat. No. 4,852,364.

*(Official Gazette,* April 22, 1997)